United States Patent [19]

Lamos et al.

[11] 4,374,586

[45] Feb. 22, 1983

[54] DOCUMENT FEED SHEET ALIGNER

[75] Inventors: Richard A. Lamos, Delrey Beach, Fla.; Alfonso A. Rosati, Longmont, Colo.

[73] Assignee: International Business Machines Corporation, Armonk, N.Y.

[21] Appl. No.: 218,139

[22] Filed: Dec. 19, 1980

[51] Int. Cl.[3] ..... B65H 3/06; B65H 9/04

[52] U.S. Cl. ..... 271/37; 271/117; 271/171; 271/250

[58] Field of Search ..... 271/117, 171, 223, 224, 271/144, 118, 116, 120, 37, 38, 10, 250

[56] References Cited

U.S. PATENT DOCUMENTS

| | | | |
|---|---|---|---|
| 566,670 | 8/1896 | Dummer . | |
| 781,504 | 1/1905 | Dummer . | |
| 1,055,639 | 3/1913 | Juengst | 271/118 |
| 3,008,709 | 11/1961 | Buslik | 271/10 |
| 3,647,207 | 3/1972 | McPherson | 271/171 X |
| 3,761,079 | 9/1973 | Azure | 271/116 |
| 3,762,701 | 10/1973 | Hannon et al. | 271/118 X |
| 4,098,501 | 7/1978 | Tani et al. | 271/117 |
| 4,189,138 | 2/1980 | Kaneko | 271/109 |
| 4,306,713 | 12/1981 | Avritt et al. | 271/37 |

*Primary Examiner*—Bruce H. Stoner, Jr.
*Attorney, Agent, or Firm*—Joscelyn G. Cockburn; Francis A. Sirr

[57] ABSTRACT

Apparatus shown for feeding documents of selected width singly from a stack in alignment without buckling. Guides are provided at either side of a bin for holding a stack of documents. One guide is fixed and the other adjustable in order that the bin may hold stacks having documents of selected widths. A shingler (combing wheel) shingles the documents forward to a separator/restraint station, which feeds the documents singly. In order to properly align the sheets for separation, the adjustable guide is connected by an adjustment device to the shingler wheel. The adjustment device (e.g., cable and pulley) is arranged to move the shingler wheel half the distance the adjustable guide is moved. This keeps the shingler wheel centered with respect to the documents. The separator/restraint station is positioned so as to always be to the side of the shingler wheel towards the fixed guide to abut each separated sheet against an alignment edge thereof for precise alignment thereof.

21 Claims, 7 Drawing Figures

DOCUMENT FEED SHEET ALIGNER

CROSS-REFERENCE TO RELATED APPLICATIONS

U.S. patent application Ser. No. 063,622, filed Aug. 3, 1979, Clay et al., "Apparatus For Applying, Varying and Removing A Normal Force In A Shingler Wheel Type Document Feeder," now U.S. Pat. No. 4,305,577. U.S. patent application Ser. No. 143,954, filed Apr. 25, 1980, Avritt et al., "Document Feeder," now U.S. Pat. No. 4,306,713.

BACKGROUND OF THE INVENTION

The invention relates to the field of sheet feeding and, more particularly, to the alignment of sheets shingled and fed singly from a stack of sheets.

Feeding sheets forward from a stack by shingling or combing with a roller has been known for many years, such as shown by U.S. Pat. No. 566,670, E. Dummer, "Paper Feeding Machine." Shingling sheets by means of a wheel containing many rollers (a shingling or combing wheel) has also been known, e.g., U.S. Pat. No. 781,504, E. Dummer, "Paper Feeding Machine." In each instance, the rollers are wider than the sheets being fed and no alignment guides are provided. Alignment of the sheets has been presumed. However, the potential rotational torque effect of shingling was clearly recognized in U.S. Pat. No. 3,008,709, W. S. Buslik, "Sheet Separating and Feeding Apparatus," where torque of a shingler was employed to separate sheets by rotating the sheets.

Shingling has been employed in recent years to feed blank sheets in at least one system, the IBM 6670 Information Distributor. The shingler wheel is smaller than the width of the sheets and is not precisely centered. Alignment is not a problem because the sheet feed path is relatively long and allows considerable distance for alignment prior to entering the using transfer station.

In feeding original documents into a machine such as a copier, it is advisable to reduce the length of the paper path between adjacent stations to a minimum in order to keep the machine as compact as possible. Therefore, alignment of original documents leaving a feeder for positioning on a document glass to be scanned and copied becomes important.

SUMMARY OF THE INVENTION

In a document feeder with a bin for holding a stack of documents to be fed, a fixed guide and an adjustable guide are provided on opposite sides of the bin. The adjustable guide allows insertion of stacks of documents of selected widths. Shingling apparatus shingles the documents forward for feeding along a direction of feed. The fixed guide provides an alignment edge for aligning the documents as they are shingled and fed. Adjustment apparatus connects the adjustable guide to the shingler apparatus for moving the shingler apparatus feed centerline half the distance the adjustable guide is moved, thereby keeping the shingling centerline centered with respect to the inserted stack of documents.

In another aspect of the invention, a separator/restraint station is provided to feed the shingled documents singly, and is positioned to the side of the shingler centerline, as extended in the direction of feed, towards the fixed guide.

DESCRIPTION OF THE PREFERRED EMBODIMENT

Figure 1:
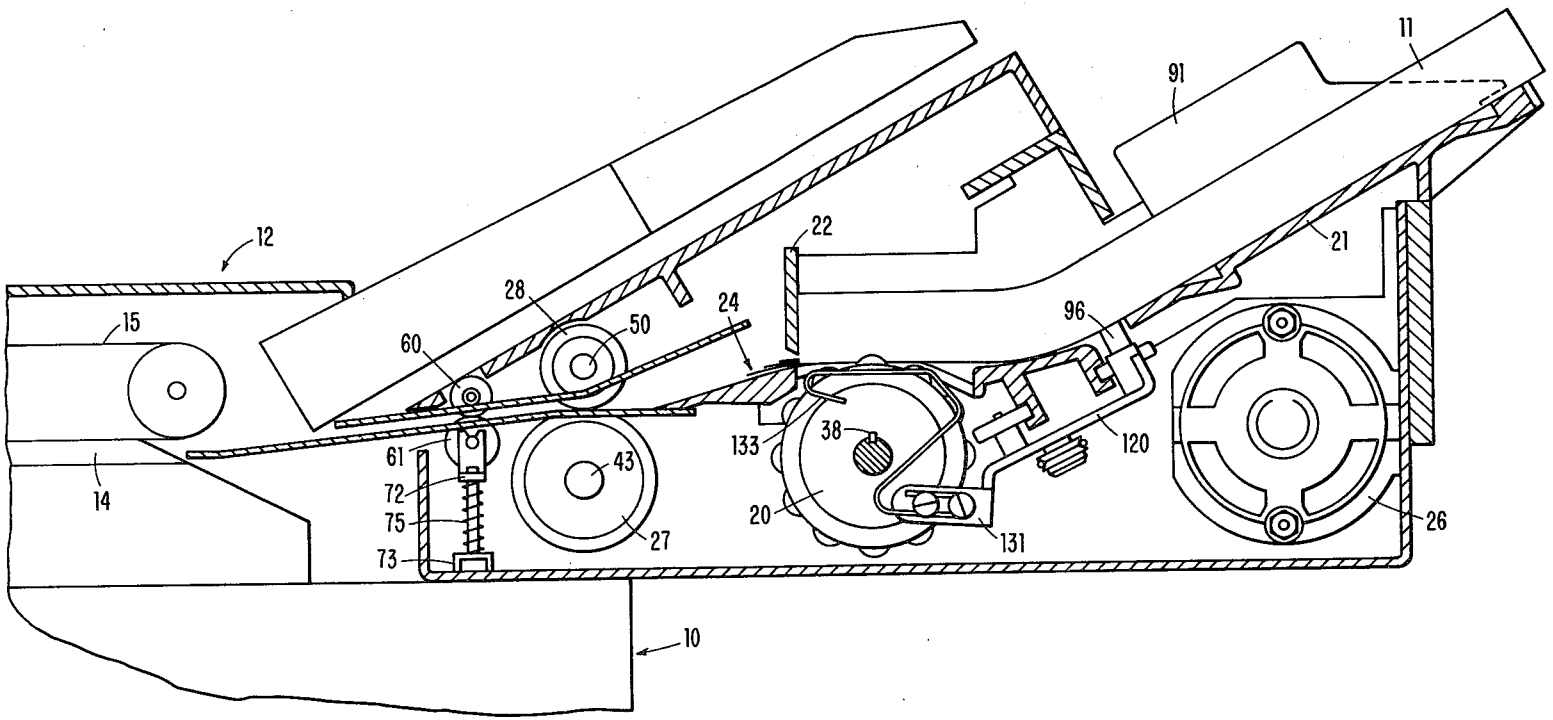
FIG. 1 is a side cross-sectional view of the apparatus of the present invention, including a stack of original documents.

An example of a sheet feeding device in accordance with the present invention is illustrated in FIG. 1. The feeder may be attached to a copier 10 to automatically supply original documents from a stack 11, singly to an imaging station 12 of the copier. The imaging station includes a document glass 14 and a drive belt 15 for positioning each original document suitably on the document glass 14.

The sheet feeder for the present invention is of the shingler type, in which a shingler wheel 20 is employed to shingle the sheets from stack 11. The stack of sheets is supported in a tray 21, which is generally inclined at a slight angle downwardly toward the imaging station 12. A stacking edge or lip 22 forms a front alignment edge for the stack of sheets, and is spaced from tray 21 to form a gate therebetween for the sheets to be shingled forward. A shingled stack of documents 24 is formed by the shingler wheel 20, which is driven by motor 26. The sheets from stack 11 are shingled forward to a separator roll 27 and restraint roll 28. Specific details of the document feeder to which the present invention is a substantial improvement, are described in more detail in the above-referenced related applications of Clay et al. and of Avritt et al.

Individual sheets may be advanced to the imaging station by separator roll 27 which feeds the bottom-most sheet from the shingled stack to the drive belt 15, while restraint roll 28 is urged in the reverse direction to engage and prevent more than one sheet from being fed forward, and also engages the sheet being fed forward and rolls therewith. Thus, in normal operation, the resultant motion of restraint roll 28 is oscillatory in nature, rotating forward one instant, and in the reverse direction the next instant.

With the shingler wheel 20 not precisely laterally centered with respect to the sheets in stack 11 being shingled, the shingler wheel will produce a torque on the stack tending to rotate the bottom-most sheet about the center of gravity of the stack. Similarly, separator roll 27 pulls the bottom sheet forward at a faster rate than shingler wheel 20. Thus, the separator roll being located toward the edge of the sheet being separated, tends to rotate the sheet about the shingler wheel 20. These effects will be discussed in more detail hereinafter.

Figure 2:
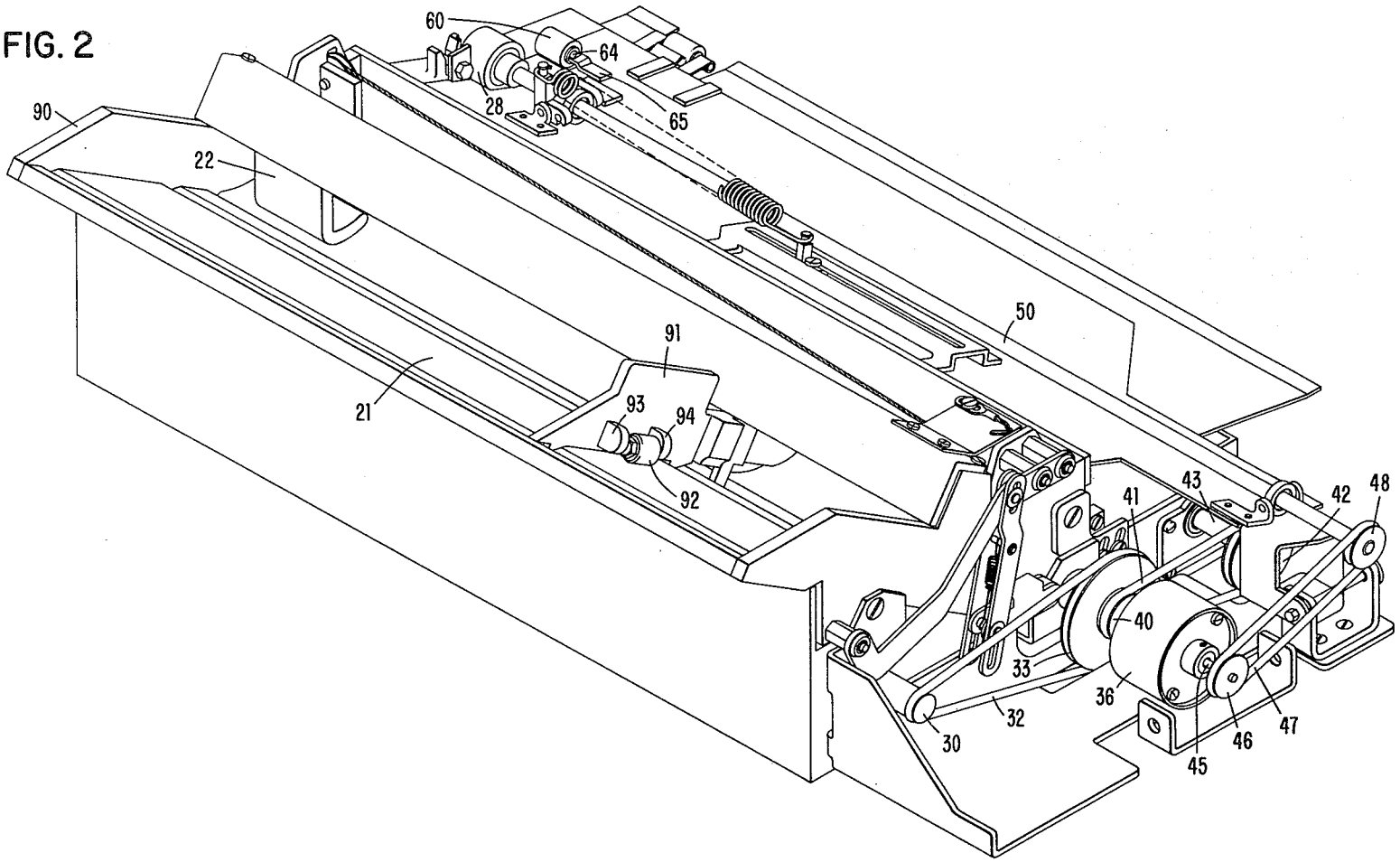
FIG. 2 is a perspective view of the document feeder of FIG. 1.
Figure 3:
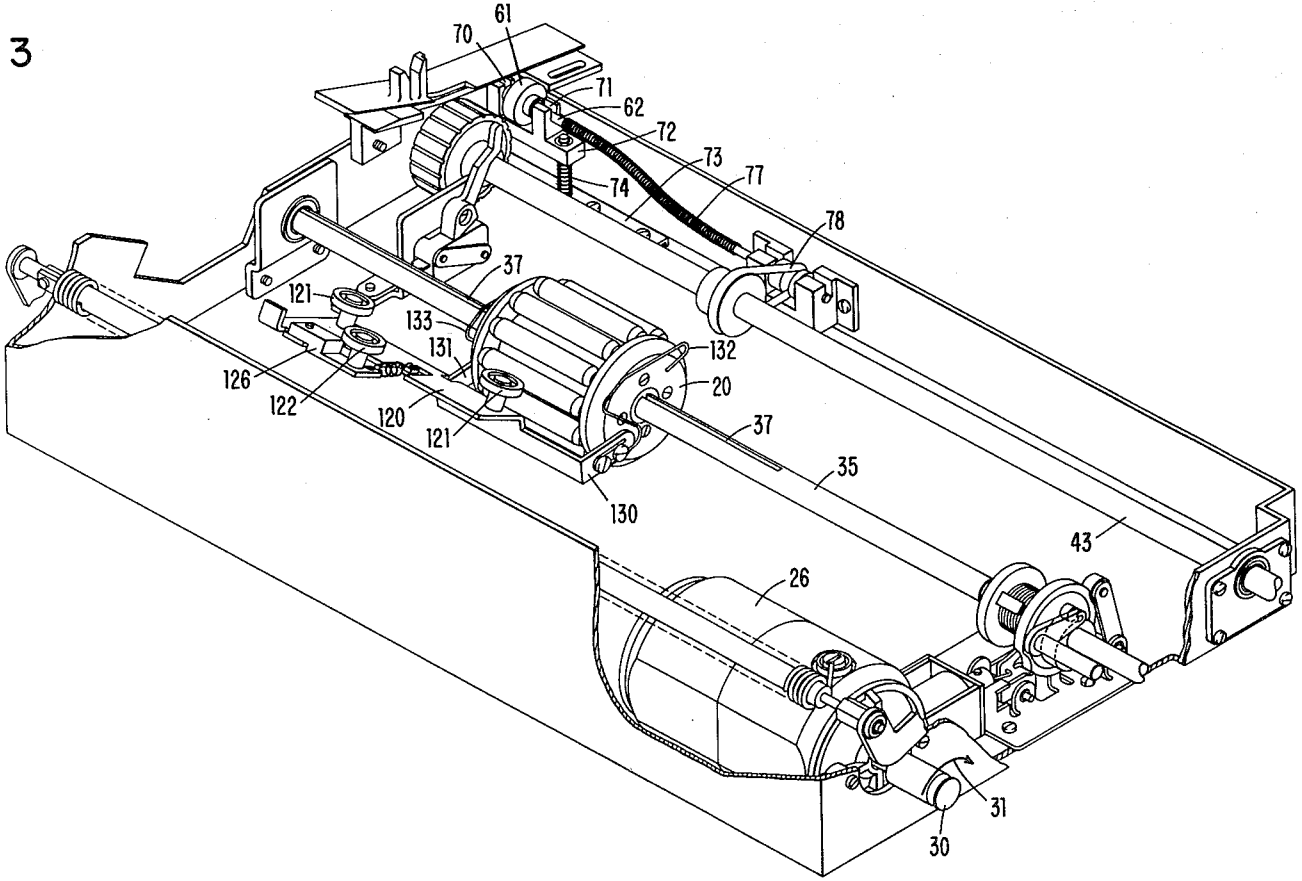
FIG. 3 is a partially cut away perspective view of the document feeder of FIG. 1.

Referring additionally to FIGS. 2 and 3, the motor 26 rotates shaft 30 in the direction of arrow 31. Belt 32 is mounted on shaft 30 and on pulley 33, which is keyed to shaft 35. Belt 32 therefore imparts the rotary motion of shaft 30 to pulley 33 and to shaft 35. Shaft 35 is suitably mounted in bearings for rotation.

The present invention adds to shaft 35 a longitudinal slot 37. Shingler wheel 20 is mounted on shaft 35 and a key 38 is press-fit into the shingler wheel. The key rides in slot 37 and causes shingler wheel 20 to rotate with shaft 35. The shingler wheel 20 may comprise any suitable shingling or combing wheel, but is preferably that described in U.S. Pat. No. 4,126,305 to Colglazier et al., "Combing Wheel," issued Nov. 21, 1978.

As described in the above cross-referenced patent applications, the shaft 35 also has fixedly mounted thereon, a slip clutch 36, and a pulley 40. The pulley 40 drives belt 41, which in turn drives pulley 42 mounted on shaft 43, which is mounted in suitable bearings. The shaft 43 is fixedly attached to and drives, separator roll 27.

Slip clutch 36 includes an output shaft 45 fixedly attached to pulley 46. A belt 47 is mounted on pulley 46 and on pulley 48. The slip clutch 36 is arranged so that output shaft 45 tends to rotate in the same direction as shaft 35. Therefore, the output shaft urges pulley 46 in the clockwise direction, thereby urging belt 47 and pulley 48 also in the clockwise direction. Pulley 48 is fixedly attached to a shaft 50, which is mounted for rotation in suitable bearings and has fixedly mounted thereon restraint roll 28. Slip clutch 36 thus urges restraint roll 28 in the clockwise direction in FIG. 2, the counterclockwise direction in FIG. 1.

FIG. 2 also illustrates an idle roll 60 mounted on an internal bearing 64 for rotation on bracket 65. FIG. 3 illustrates a feed roll 61 forming a nip with idle roll 60. The feed roll 61 is mounted on shaft 62 which, in turn, is mounted in slots 70 and 71 on bracket 72. The bracket is supported on frame member 73 by spring units 74 and 75 (see also FIG. 1), each of which includes both an alignment post and a compression spring. Shaft 62 is attached to a flexible shaft 77 which is mounted to drive mechanism 78, which obtains its rotary drive from shaft 43 of separator wheel 27.

Figure 4:
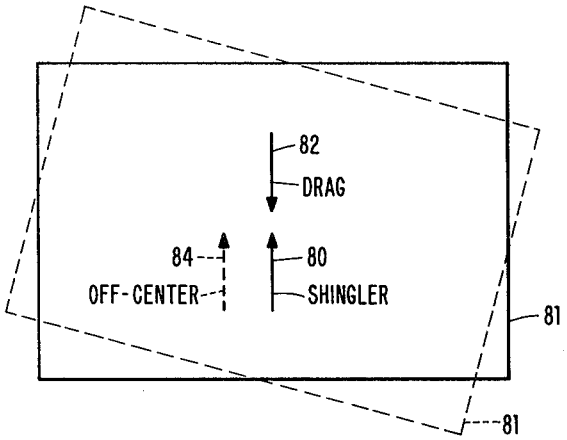
FIG. 4 is a diagrammatic view of forces acting on a document in the present invention.

FIG. 4 illustrates the forces acting on a sheet in the shingling sheet feed environment. If the shingler wheel is, as in the prior reference, wider than the sheets being shingled, or if the shingling wheel is precisely centered with respect to the stack of sheets, the shingling wheel will produce a centered force as represented by arrow 80 on sheet 81. The drag on the bottom-most sheet 81, resulting from the friction developed by the stack of sheets, is also centered with respect to sheet 81 and is represented by arrow 82. With the shingling force and the drag force center line being coextensive, the shingler moves sheet 81 straight ahead without skew.

However, should the shingling wheel be slightly off center, or 14 inch long sheets be used with a shingler centered for 11 inch long sheets, the shingling force center line would be represented by arrow 84. The drag force 82 remains centered with respect to the individual sheet 81 in accordance with the stack of sheets, making the shingling force 84 and drag force 82 no longer coextensive. With the forces now being offset and not coextensive, the forces create a moment causing the skewing of sheet 81 as shown by the dotted lines in FIG. 4.

The present invention includes a reference edge guide 90 and, as shown in FIG. 2, an adjustable edge guide 91. The adjustable edge guide is supported by roller 92, which is supported for rotation in supports 93 and 94, forming a part of the adjustable guide 91. Arm 96 also supports guide 91 and provides the connection to further apparatus to be described so that the guide may be moved to the outer edge of a stack of sheets on document support member 21, which stack may be positioned against reference guide 90.

Figure 5:
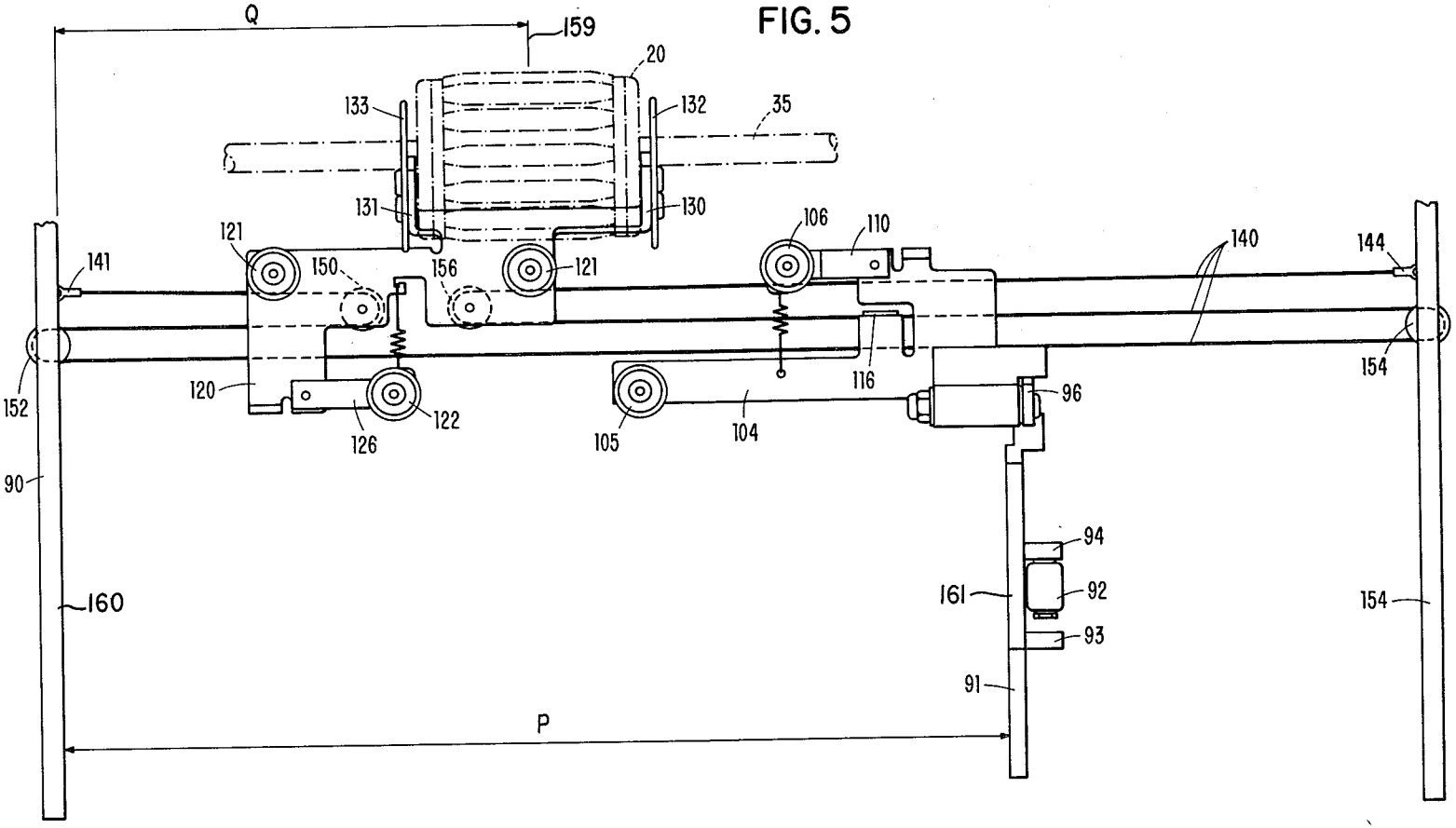
FIG. 5 is a schematic view of the shingling and adjustment apparatus of FIG. 1.
Figure 6:
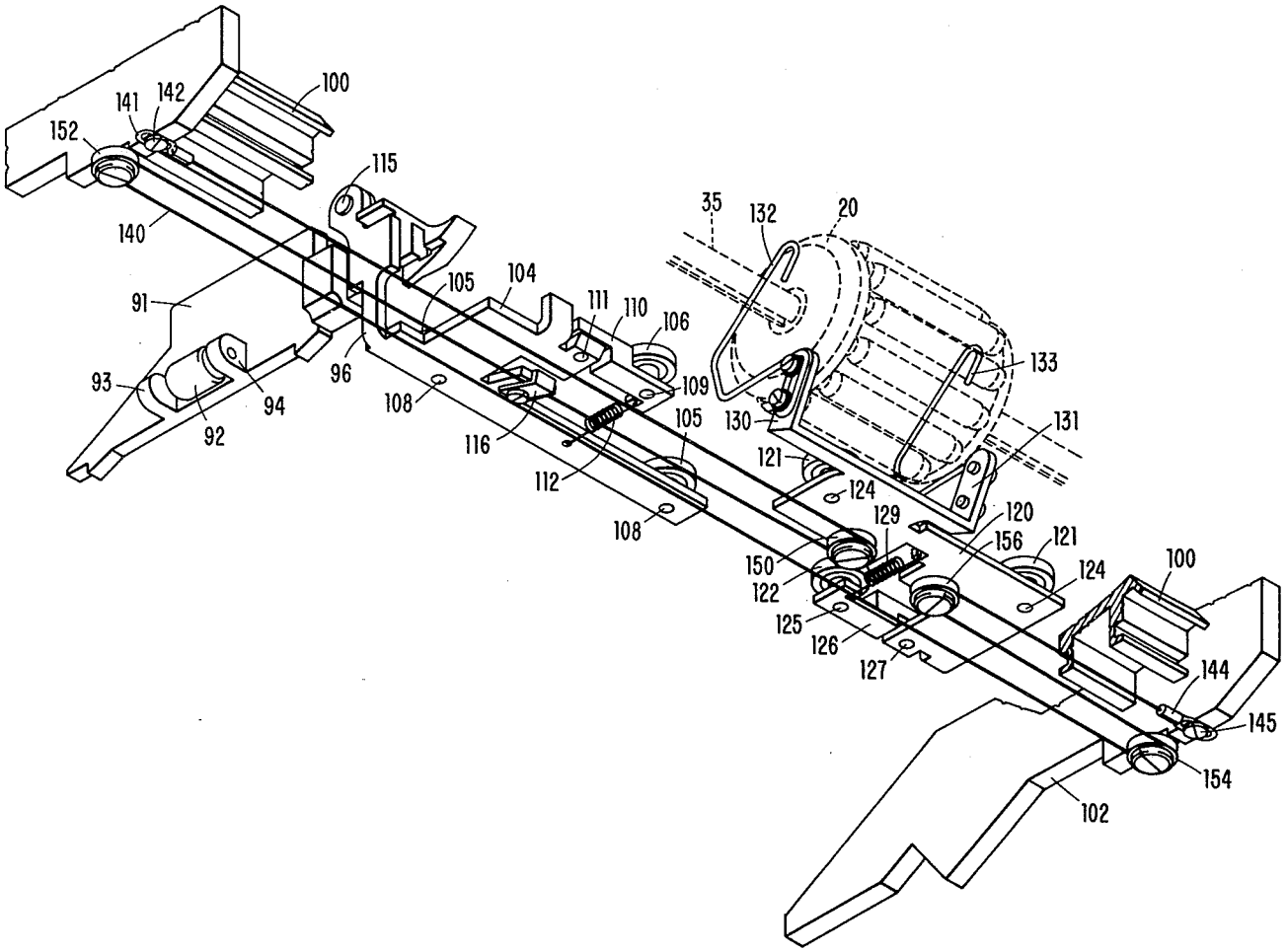
FIG. 6 is a partially sectional view of shingling and adjustment apparatus of FIG. 1.

Referring jointly to FIGS. 5 and 6, the adjustment mechanism for adjusting the lateral position of shingler wheel 20 on shaft 35 is illustrated. A rail 100 is mounted between front guide plate 90 and a rear plate 102. Arm 96 is connected to adjustable paper guide 91, and forms an extension of carriage plate 104. Fixed rollers 105 and adjustable roller 106 mount in rail 100 to move the carriage therealong. Rollers 105 include appropriate bearings for mounting on pins 108, supported by carriage plate 104. Roller 106 includes a suitable bearing for mounting on pin 109, supported by bracket 110. Bracket 110 is mounted for rotation on pin 111 and is held in rail 100 under tension by means of spring 112. Arm 96 of carriage plate 104 is connected to adjustable paper side guide 91 by means of pin 115. Alignment carriage plate 104 also includes a clamp 116, which will be explained hereinafter.

A shingler alignment plate 120 is provided, to which fixed rollers 121 and adjustable roller 122 are attached. Rollers 121 are mounted in suitable bearings on pins 124 which are supported by plate 120. Roller 122 is mounted in a suitable bearing on pin 125 supported by pivot arm 126. Arm 126 is pivotably supported by pin 127, and holds roller 122 in tension in rail 100 by means of spring 129.

Rollers 105 and 106 of carriage plate 104, and rollers 121 and 122 of plate 120, are all supported in rail 100. In FIG. 5, which is a diagrammatic figure only, the plates 104 and 120 are shown as being offset. This is diagrammatic only to provide a better view of remaining aspects of the invention.

Plate 120 includes brackets 130 and 131, which support, respectively, guide members 132 and 133. Guide members 132 and 133 are positioned, respectively, on either side of shingling wheel 20, and hold it in position or move it to a new position along shaft 35.

A cable 140 is affixed at one end to guide plate 90 by anchor 141 and screw 142. The other end of cable 140 is affixed to plate 102 by means of anchor 144 and screw 145. The cable 140 is wound, respectively on pulley 150 of plate 120, on pulley 152 of guide plate 90, on pulley 154 of plate 102, and on pulley 156 of plate 120.

The cable is wound around the pulleys as described, and tensioned during the attachment of anchors 141 and 144. Carriage plate 104, not yet attached to cable 140, and alignment guide 91 are moved to a desired position, distance P from fixed reference guide 90, and plate 120 and shingler 20 are moved to a position at distance Q from reference guide 90, which is equal to one-half of distance P. Clamp 116 is then tightened onto cable 140, to affix cable 140 to carriage plate 104. In this position, shingler 20 is precisely centered with respect to distance P, which represents the width of a stack of paper. The pulley arrangement is such that any movement of side guide 91 results in movement of plate 120 and shingler wheel 20 in the same direction, but one-half the distance moved by guide 91 and carriage plate 104, as can be readily visualized.

The center line 159 of shingler 20, therefore, always remains precisely centered between the reference edge 160 formed by edge drive plate 90 and edge line 161, formed by alignment plate 91.

In operation, a stack of sheets are placed on support 21 and positioned against reference guide 90. Alignment guide 91 is moved into position against the opposite side of the stack of sheets. The movement of guide 91, and thereby carriage plate 104 in FIGS. 5 and 6, results in the movement of cable 140 about the pulleys to thereby position plate 120, and thereby shingler wheel 20 at a position such that the center line 159 of the shingler wheel is one-half the distance from line 160 to line 161 and is thereby precisely centered with respect to the stack of sheets. Referring again to FIG. 4, center line 159 of shingler wheel 20 is therefore coextensive with force line 80 in FIG. 4. The force line represents the center line of the shingling force of shingler 20. Inasmuch as it is centered with respect to the stack of sheets, it is therefore also coextensive with, but opposite in direction to, the center line 82 of the drag force caused by the weight of the stack of sheets on the bottom-most sheets. Each of the sheets in the stack will therefore be shingled forward in the direction of arrow 80 without skew.

So long as sheets are shingled forward without skew, the sheets will be presented one-at-a-time to separator roll 127, the bottom-most sheet arriving first. Restraint roll 28 will thus be able to hold back the next sheet or sheets so that only the bottom-most sheet of stack 11 is fed as shown in FIG. 1.

Figure 7:
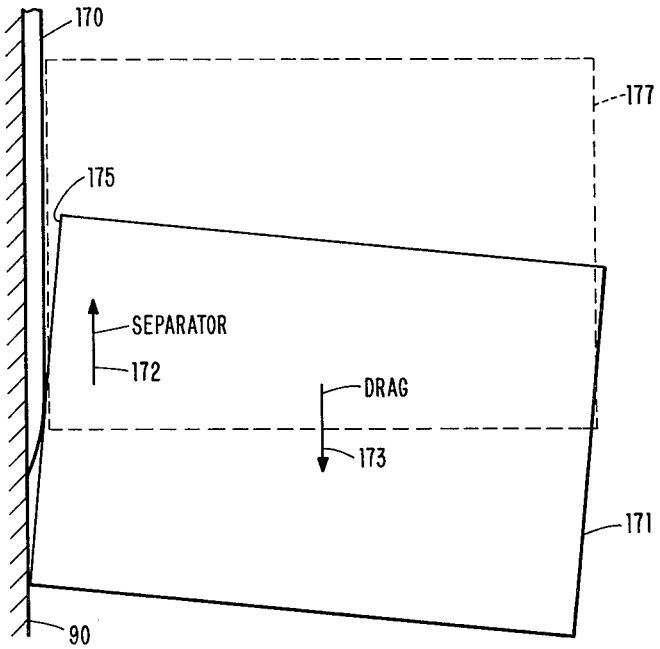
FIG. 7 is a top plan view showing diagrammatically forces acting on a document which is being side aligned.

Referring now to FIG. 7, the precise alignment of the singly fed sheets by separator roll 27 will be described. A reference edge 170 is provided slightly offset from reference guide plate 90 of FIG. 2. The speed of separator roll 27 is such that the separated bottom-most sheet from the stack is moved forward at a much faster rate than if driven by shingler wheel 20. Thus, the separator roll provides a substantial force 172 in the forward direction, while shingler wheel 20 and the friction from the weight of the stack of sheets on at least the rear portion of the separated sheet 171, represents a drag force 173. As shown in FIG. 3, separator roll 27 is positioned to the left of shingler 20. Therefore, sheet 171 is skewed in a clockwise direction by the moment developed by the separator drive force 172 and the drag force 173 acting on the sheet. To ensure that this moment always produces a clockwise skew, it is required that the separator 27 be located to the left of the center line of the leading edge for all sheet sizes fed. The separator roll 27 drives the skewed document forward until the left edge 175 thereof contacts the reference edge 170. The separator continues to drive the sheet forward so the front edge is forced to track against the reference edge, as shown by sheet 171 in the position represented by the dotted line 177. Because the reference edge is parallel to the separator drive direction, the position of the separator roll 27 on the sheet remains constant in the lateral direction as the sheet is fed forward. Thus, with the sheet tracking straight, there is no force component driving the sheet against the reference edge 170 acting to buckle the sheet.

Further, the sheet is thus precisely aligned against reference edge 170 and in the proper position to be fed onto document glass 14 by belt drive 15.

It is seen that the precise centering of the shingler wheel 20 causes the sheets of stack 11 in FIG. 1 to be shingled forward in precise fashion without skew. This assures that only the bottom-most sheet will be engaged by separator roll 27 for separation. The positioning of separator roll 27 to the left of the center line of the stack of sheets 11, and thereby to the left of the center line of the shingling wheel 20, causes the separated bottom-most sheet to be skewed in the clockwise direction to abut against reference edge 170 for precise alignment and true tracking to the next station.

In this manner, the present invention provides both reliable feeding of a single sheet at a time and in the proper order in accordance with placement in stack 11, and precisely aligns each separated sheet over a very short distance, which may be less than the length in the feed direction of the sheet being fed.

While the invention has been particularly shown and described with reference to the above preferred embodiments thereof, it will be understood by those skilled in the art that various changes in form and details may be made therein without departing from the spirit and scope of the invention.

What is claimed is:

1. In a document feeder having feeding means for feeding documents from a stack of documents in a bin to a utilization device, the improvement comprising:

fixed guide means at a first side of said bin and parallel to the direction of said feeding of said feeding means, for positioning of said stack of documents adjacent thereto;

an alignment means connected to the guide means downstream of the bin and offset from said guide means in a direction transverse that of forward document motion into the path of the documents, said alignment means being operable for aligning the documents;

adjustable guide means at a second side of said bin opposite said first side for adjustment to a position immediately adjacent said stack of documents;

adjustment means connected to said adjustable guide means for moving said feeding means laterally of the direction of said feeding half the distance said adjustable guide means is adjusted; and a separator means receiving said documents from said feeding means with said separator means coacting with the feeding means for feeding said documents in a first nonlinear path until the document abuts the alignment means which forces said document into lateral alignment prior to entry into the utilization device.

2. The improvement of claim 1 wherein:

said adjustment means additionally moves said feeding means laterally in the same direction as said adjustment of said adjustable guide means.

3. The improvement of claim 2 wherein:

said adjustment means additionally comprises cable and pulley means.

4. The improvement of claim 3 wherein:

said cable and pulley means further includes anchor means to hold stationary each end of said cable, said adjustable guide means is attached to said cable, and said cable is wound on pulleys on said feeding means.

5. The improvement of claim 1 wherein:

said alignment means comprises a reference edge shorter than said documents against which singly fed documents are tracked for alignment thereof.

6. A document feeding means for feeding documents from a stack of documents in a bin, comprising:

shingling means for shingling said documents of said stack forward along a direction of feed centerline;

first guide means at a first side of said bin parallel to said direction of feed centerline, for positioning said stack of documents immediately adjacent thereto;

alignment means connected to the first guide means and operable for aligning a sheet laterally, said alignment means being positioned forward of said first guide means, and being offset transverse from said first guide means, into the path of said documents;

adjustable guide means at a second side of said bin opposite said first side parallel to said direction of feed centerline, for adjustment to a position immediately adjacent said stack of documents;

adjustment means connected to said adjustable guide means for adjusting the distance between said direction of feed centerline and said first guide means one half the adjustment distance of said adjustable guide means with respect to said first guide means; and a separator means located laterally between said direction of feed centerline and a second line extending from said first guide means parallel to said direction of feed centerline, with said separator means feeding said documents singly at a velocity greater than that of said shingling means to skew the document clockwise and forcing the rear of the side edge of each said singly fed documents against said alignment means for lateral alignment.

7. The document feeding means of claim 6 wherein:

said adjustment means adjusts said adjustment distances in the same direction.

8. The document feeding means of claim 7 wherein:

said adjustment means is arranged so that said direction of feed centerline is maintained approximately midway between said first guide means and said adjustable guide means.

9. The document feeding means of claim 7 wherein:

said adjustment means additionally comprises cable and pulley means.

10. The document feeding means of claim 9 wherein:

said first guide means is fixed;

said cable of said cable and pulley means is fixed at each end;

said adjustable guide means is additionally attached to said cable of said cable and pulley means; and said shingling means additionally comprises pulleys on which are wound said cable of said cable and pulley means.

11. The document feeding means of claim 7 wherein:

said shingling means additionally is narrower than said sheets in said stack and is mounted on rails for movement by said adjustment means orthogonal to said direction of feed centerline; and said first guide means is fixed.

12. The improvement of claim 6 wherein:

said alignment additionally comprises a reference edge shorter than said documents against which said singly fed documents are tracked for alignment thereof.

13. In a document feeder having shingler means for shingling documents from a stack, the improvement comprising:

bin means having:

a support member for supporting said stack of documents;

a first guide means fixed at one side of said support member for registering against a first side of a stack of documents;

an alignment member integrally connected to the first guide means, said alignment member being positioned downstream of said bin means, and being offset from said first guide means in a direction transverse that of forward document motion, into the path of the documents;

an adjustable guide means disposed at the opposite side of said support member from said first guide means for adjustment of the distance to accommodate different size documents;

adjustment means responsive to the adjusted position of said adjustable guide means of said bin means for correspondingly adjusting the position of said shingler means relative to said bin means so the shingler means is centered midway between said first guide means and said adjustable guide means of said bin means; and separator means receiving said documents from said shingler means for feeding said documents singly at a velocity greater than that of said shingler means, said separator means located laterally between said shingler means and said first guide means, whereby said separator means forces the rear of the side edge of each said singly fed document against said alignment member while being singly fed for lateral alignment.

14. The improvement of claim 13 wherein:

said adjustment means additionally comprises cable and pulley means.

15. The improvement of claim 14 wherein:

said bin means is fixed; and said adjustment means is additionally arranged to move said shingler means.

16. The document feeding means of claim 14 wherein:

said cable of said cable and pulley means is fixed at each end;

said adjustable guide means is additionally attached to said cable of said cable and pulley means; and said shingler means additionally comprises pulleys on which are wound said cable of said cable and pulley means.

17. The document feeding means of claim 13 wherein:

said shingler means additionally is narrower than said documents in said stack and is mounted on rails for movement by said adjustment means orthogonally between said guide means of said bin means.

18. The improvement of claim 13 wherein:

the alignment member is shorter than said documents against which said singly fed documents are tracked for alignment thereof.

19. The improvement of claim 1 wherein the separator means is being located laterally between first and second lines extending parallel to the direction of said feeding of said feed means with said first lines extending from said feeding means and said second line extending from said fixed guide means.

20. The improvement of claim 1 wherein said separator means feeds single documents at a velocity greater than that of said feeding means.

21. In a document feeder having shingler means for shingling documents from a stack, the improvement comprising:

a bin for supporting a stack of documents, said bin having at least one reference edge against which a stack of documents is registered;

an alignment edge connected to the reference edge and positioned therefrom in the direction of forward sheet motion, said alignment edge being laterally offset from said reference edge, into the path of forward sheet motion;

a sheet feeding means, including the shingler means disposed to shingle sheets from the bottom of the stack; and a sheet separator means disposed to accept and feed individually shingled sheets in seriatim and to coact with the sheet feeding means to feed individual sheets in a clockwise direction until the edge of the sheet adjacent to the alignment edge contacts said edge for lateral alignment prior to delivery into a utilization device.

* * * * *